US005341859A

United States Patent [19]

Howseman, Jr.

[11] Patent Number: 5,341,859

[45] Date of Patent: Aug. 30, 1994

[54] DISPENSING CARTRIDGE FILLING SYSTEM

[76] Inventor: William E. Howseman, Jr., 150 E. Los Angeles Ave. #205, Moorpark, Calif. 93021

[21] Appl. No.: 140,562

[22] Filed: Oct. 25, 1993

[51] Int. Cl.[5] ..... B65B 1/30

[52] U.S. Cl. ..... 141/198; 222/64; 222/504; 141/284; 141/83; 141/96

[58] Field of Search ..... 141/198, 83, 96, 284, 141/264, 276, 351, 357; 222/64, 504, 325

[56] References Cited

U.S. PATENT DOCUMENTS 2,703,194 3/1955 White ..... 141/96
3,527,267 9/1970 Moore ..... 141/198 X
3,993,111 11/1976 McLennand ..... 141/198 X
4,860,804 8/1989 Yamaguchi et al. ..... 141/83 X

*Primary Examiner*—Gregory L. Huson
*Attorney, Agent, or Firm*—Linval B. Castle

[57] ABSTRACT

Apparatus for filling tubular dispensing cartridges with paste or viscous fluid comprises a mandrel adapted for a sliding fit within the cartridges, the mandrel having an axial fluid passage and a parallel air passage which extends from the mandrel top to an radial opening near the mandrel bottom surface. A pneumatic control system controls the amount of paste or fluid by sensing the flow of air through the air passage. If air passes through the passage, the fluid valve is closed; if air is blocked by a cartridge on the mandrel, the fluid valve is enabled and a manual control valve may be used.

6 Claims, 2 Drawing Sheets

DISPENSING CARTRIDGE FILLING SYSTEM

This invention relates to filling systems and particularly to apparatus for automatically filling tubular cartridges with a viscous material to be dispensed.

BRIEF SUMMARY OF THE INVENTION

There are very many different types of filling systems being used for filling cartridges with various types of fluids and viscous materials, all requiring that the material be inserted into the cartridge without air bubbles. In some cases, it is necessary to apply vacuum to the cartridge as it is being filled to draw the air out as the viscous fluid is inserted. In others, air is eliminated by use of a filling mandrel which fits entirely inside the cartridge and the mandrel forces the cartridge off by filling it with the fluid. In cartridges having a single opening for both filling and dispensing, this may require some vacuum in applying the cartridge to the mandrel. In cartridges having a dispensing opening at the opposite end of the filling opening, the cartridge is merely slipped over the mandrel before the cap is put on the dispensing end.

The problem is in the gauging the fluid that is applied into the cartridge. A viscous fluid such as paste or epoxy is very difficult to gauge by standard methods. There are gauging systems available for use with the mandrel type of filling apparatus which use a roller actuated limit switch mounted to contact the exterior surface of a cartridge being filled. When the nearly filled cartridge is pushed down on the mandrel by the filling action, the roller notes the diameter change and shuts off the fluid. This system works well as long as everything is kept clean; however, as new cartridges are applied, fluid material tends to build up on the mandrel, is very difficult to clean and causes the limit switch to malfunction.

The present invention is for an improved system for filling dispensing cartridges with a variety of liquids and paste materials. It is shown for use with a cartridge having a dispensing opening at the opposite end of the filling opening but, by providing a simple vent to the mandrel, may be used with a single opening cartridge.

Briefly described the invention includes a filling mandrel adapted for sliding fit within the length of a tubular cartridge to be filled. The mandrel has an axial fluid conduit and also an enclosed air duct substantially parallel with the axis. The air duct terminates in a radial air bleed port near the bottom of the mandrel and, near its top, at a second port connected to a pneumatic control system that operates a valve in the fluid line to the mandrel. When the air bleed port is open, the fluid valve cannot be operated, hence no fluid passes through the mandrel. But while a cartridge covers the air bleed port and until the edge of the cartridge passes the air bleed port, the fluid valve can be operated by a manual control valve in the control system. Because air pressure is used, the air bleed port is self-cleaning.

DESCRIPTION OF THE DRAWINGS

In the drawings which illustrate a preferred embodiment of the invention.

DETAILED DESCRIPTION

Figure 1:
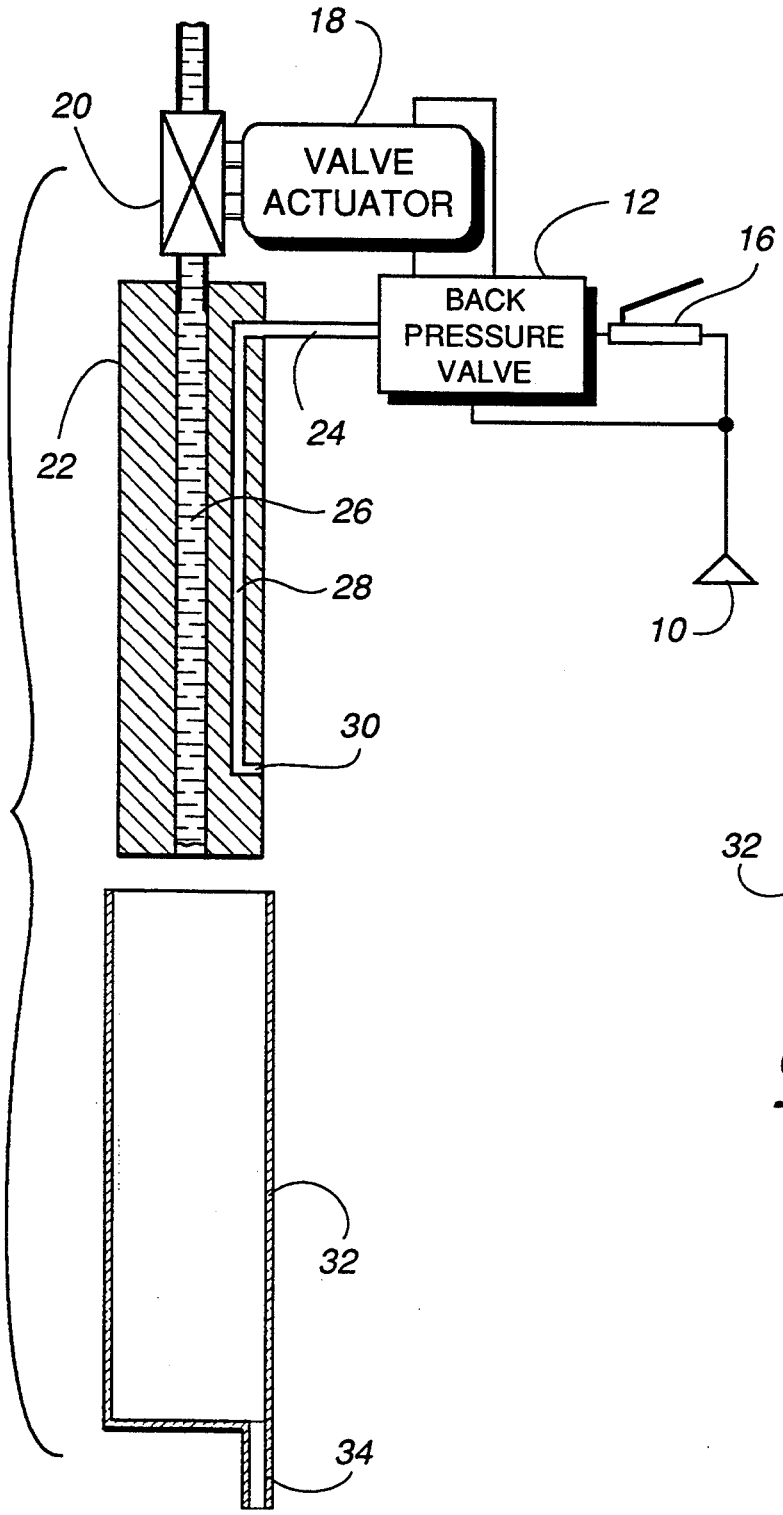
FIG. 1 is a sectional view of the filling mandrel and a cartridge and schematically shows the pneumatic control circuitry for controlling the flow of fluid through the mandrel.

The cartridge filling apparatus of the invention employs a pneumatic control system wherein air and a relatively low pressure is admitted to the system at the air input 10 and is directed to a back pressure valve 12 through the conduit 14 and also via a manually operable control valve 16. The back pressure valve 12 controls the operation of a valve actuator 18 which, in turn, controls the fluid valve 20 in series between a source of fluid and a mandrel 22.

The back pressure valve 12 has a bypass vent 24 which, when open to permit escape of the air, closes the fluid valve 20 and removes all control of the back pressure valve over the valve actuator 18. That is, the back pressure valve 12 and the manually operable control valve 16 can only open and control the valve actuator and the flow of fluid or paste through the mandrel 22 when the bypass vent 24 is blocked so that air does not escape.

The elongated mandrel 22 is constructed for a sliding fit within the bore of a tubular cartridge to be filled with a fluid, paste or viscous material such as epoxy or soft resins. It has an axial fluid conduit 26 which is coupled at the top end of the mandrel to the fluid valve 20 and a separate parallel longitudinal air conduit 28 which is connected near the top of the mandrel to the bypass vent 24 on the back pressure valve 12. A radial opening 30 through the wall of the mandrel is located about one or two inches above the bottom surface of the mandrel. The fill level of a cartridge is determined by the height of the radial opening 30 and the fill level may be changed by moving its location.

As illustrated in FIG. 1, air pressure can escape through the the air conduit 28 and thus the bypass vent 24 so that the fluid valve 20 is closed and so that the manually operable valve 16 and the back pressure valve are now inoperable.

FIG. 1 illustrates the relative positions of the mandrel 22 and a typical dual component cartridge 32 prior to mounting the cartridge on the mandrel. The cartridge and mandrel and axially aligned, as shown, and a cap has not yet been applied to the dispensing end 34 of the cartridge.

Figure 2:
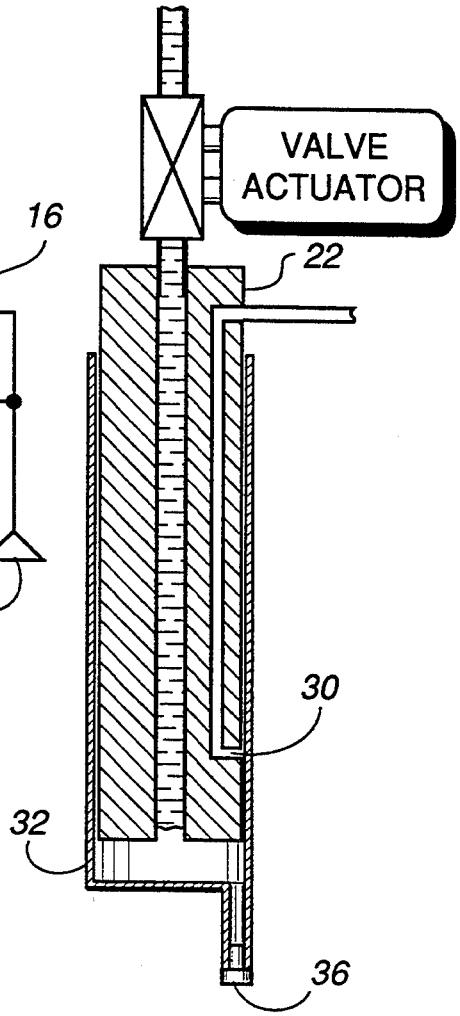
FIG. 2 illustrates the cartridge inserted on the mandrel prior to the start of filling.

FIG. 2 illustrates the cartridge 32 mounted on the mandrel 22 and ready to be filled. A cap 36 has been applied to seal the dispensing end of the cartridge, and now that the radial opening 30 is covered and substantially sealed by the walls of the cartridge, the manually control valve 16 and back pressure valve are activated.

Figure 3:
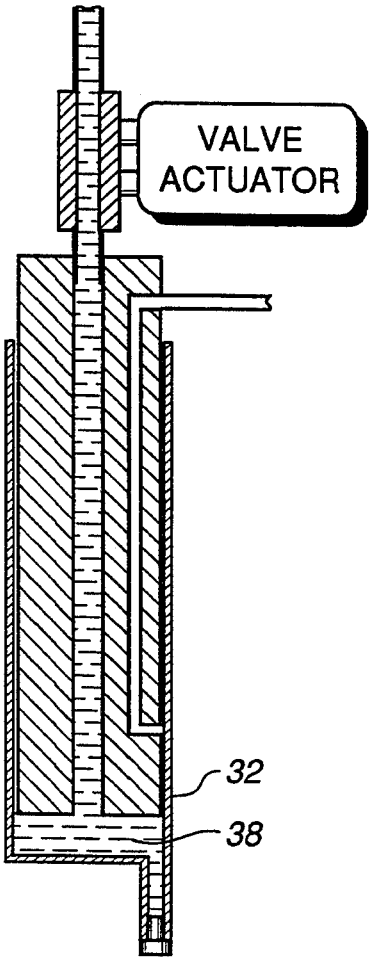
FIGS. 3 and 4 show progressive steps in the filling operation.
Figure 4:
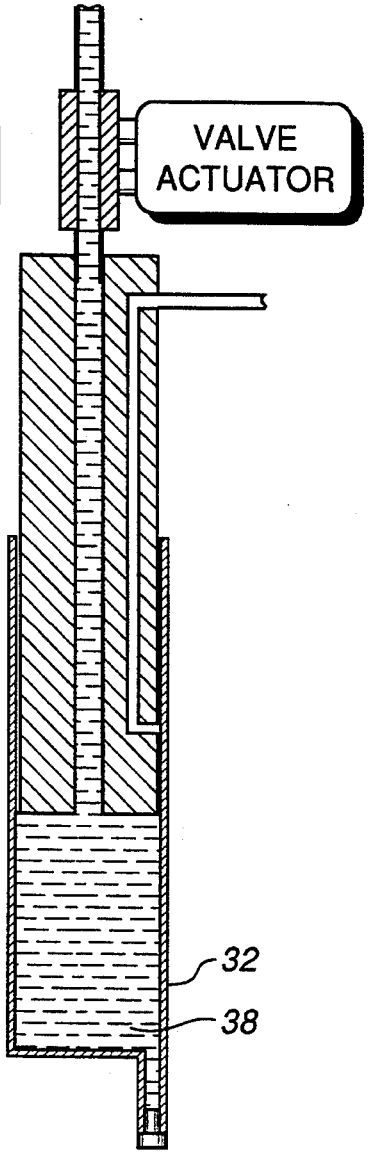

FIGS. 3 and 4 show the positions of the cartridge 32 on the mandrel 22 as more and more fluid 38 is pumped in through the fluid valve 20. Note that the ever increasing fluid forces the cartridge 32 from the mandrel 22.

Figure 5:
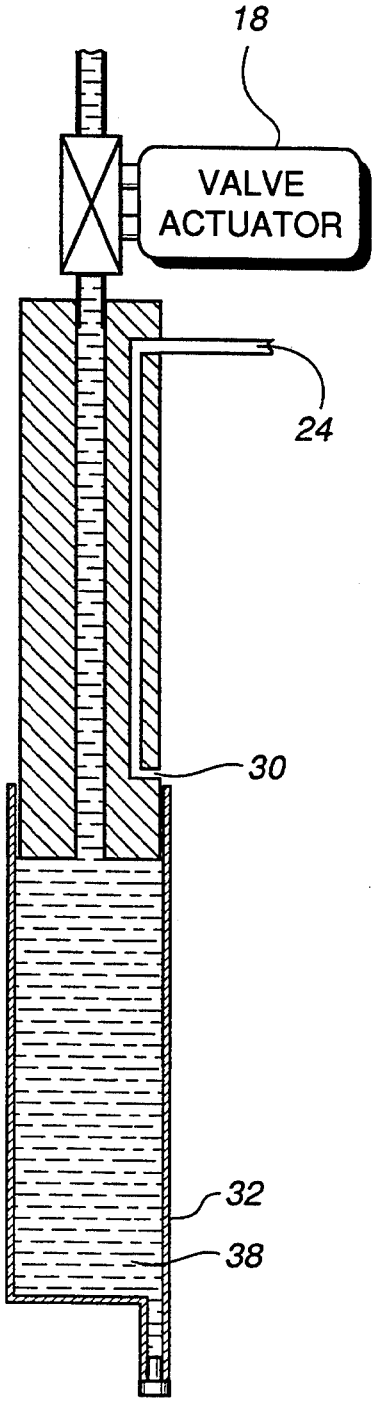
FIG. 5 illustrates the full cartridge with the air bleed port exposed to shut off further filling of the cartridge.

FIG. 5 illustrates a filled cartridge on the mandrel. The fluid in the cartridge has finally forced the cartridge 32 down to the point where its walls pass over the radial opening 30 thereby providing an air pressure release to the bypass vent 24 to automatically shut off further flow of fluid 38 into the cartridge 22.

The pneumatic control system of the invention assures an accurate deposit of fluid into each cartridge.

Furthermore, It is self-cleaning in that any fluid that may collect and dry on the exterior surface of the mandrel will not affect the amount of fluid deposited since the air flow from the bypass vent 24 through the radial opening 30 will blow out and clean any deposit that may occur.

I claim:

1. Apparatus for accurately filling tubular cartridges with fluids comprising:

an mandrel adapted for a sliding fit within a tubular cartridge, said mandrel having first and second ends, a longitudinal fluid passage therethrough and an air passage parallel to said fluid passage, said air passage extending from said first end and terminating in a radial opening through a side wall near the second end of said mandrel;

a fluid valve in series between a source of fluid and said fluid passage at the first end of said mandrel;

control means including a control valve coupled to said fluid valve and to said air passage for closing said fluid valve whenever air passes through said air passage and for enabling said manually operable means when said air passage becomes blocked.

2. The apparatus claimed in claim 1 wherein said control means is a peumatic control.

3. The apparatus claimed in claim 2 wherein said control valve is a manually operable control valve.

4. The apparatus claimed in claim 1 wherein said control means enables said control valve when a wall of a tubular cartridge is applied over said mandrel.

5. The apparatus claimed in claim 4 wherein said control means closes said fluid valve and disables said control valve when a top edge of a tubular cartridge uncovers said radial opening.

6. Apparatus for accurately filling tubular cartridges with a viscous fluid, said apparatus comprising:

a mandrel adapted for a sliding fit within the tubular cartridges, said mandrel having top and bottom ends;

an axial fluid passage extending from the top to bottom ends of said mandrel;

an air passage within said mandrel and substantially parallel to said axial fluid passage, said air passage extending from the top end of said mandrel and terminating in an axial opening through a wall of said mandrel near said bottom end;

a fluid valve in series between a source of viscous fluid and said air passage at the top end of the mandrel; and pneumatic control means including a manual control valve for controlling said fluid valve, said control means coupled to said air passage at said top end of said mandrel and responsive to the flow of air from said control means through said air passage for closing said fluid valve and responsive to a blockage of said air passage for enabling said fluid valve and said manual control valve.

* * * * *